US009248844B2

(12) United States Patent
Schlierbach-Knobloch et al.

(10) Patent No.: US 9,248,844 B2
(45) Date of Patent: Feb. 2, 2016

(54) ARRANGEMENT CONSISTING OF A TRAVELLING GEAR CARRIER AND A RUNNING WHEEL BLOCK FASTENED DETACHABLY THERETO, AND INSTALLATION METHOD THEREFOR

(75) Inventors: Thomas Schlierbach-Knobloch, Herdecke (DE); Richard Kreisner, Ennepetal (DE); Gregor Jansen, Bottrop (DE)

(73) Assignee: Terex MHPS GmbH, Duesseldorf (DE)

( * ) Notice: Subject to any disclaimer, the term of this patent is extended or adjusted under 35 U.S.C. 154(b) by 281 days.

(21) Appl. No.: 14/004,753

(22) PCT Filed: Apr. 12, 2012

(86) PCT No.: PCT/EP2012/056681

§ 371 (c)(1),
(2), (4) Date: Sep. 12, 2013

(87) PCT Pub. No.: WO2012/140143

PCT Pub. Date: Oct. 18, 2012

(65) Prior Publication Data

US 2014/0000472 A1 Jan. 2, 2014

(30) Foreign Application Priority Data

Apr. 14, 2011 (DE) ..... 10 2011 002 044

(51) Int. Cl.
*B61B 13/00* (2006.01)
*B66C 9/08* (2006.01)
*E01B 25/00* (2006.01)

(52) U.S. Cl.
CPC . *B61B 13/00* (2013.01); *B66C 9/08* (2013.01); *E01B 25/00* (2013.01); *Y10T 29/49826* (2015.01)

(58) Field of Classification Search
CPC ..... B66C 9/00; B66C 9/08; B61B 13/00; E01B 25/00
See application file for complete search history.

(56) References Cited

U.S. PATENT DOCUMENTS 4,385,562 A * 5/1983 Bitsch et al. ..... 105/163.1
4,550,664 A * 11/1985 Bitsch et al. ..... 105/180

(Continued)

FOREIGN PATENT DOCUMENTS

DE 3134750 A1 3/1983
DE 19540217 C1 1/1997

(Continued)

OTHER PUBLICATIONS

International Search Report and Written Opinion of the International Searching Authority from corresponding Patent Cooperation Treaty (PCT) Application No. PCT/EP2012/056681, mailed Jun. 21, 2012.
German examination report dated Mar. 15, 2012, that corresponds with the present patent application.
English translation of International Preliminary Report on Patentability from corresponding Patent Cooperation Treaty Patent Application No. PCT/EP2012/056681 issued Oct. 15, 2013.

*Primary Examiner* — Jason C Smith
(74) *Attorney, Agent, or Firm* — Gardner, Linn, Burkhart & Flory, LLP

(57) ABSTRACT

The invention relates to an arrangement comprising a travelling mechanism girder and a running wheel block fastened detachably thereto, wherein the running wheel block is comprised of a housing with at least one connection surface and a running wheel which is mounted in the housing and protrudes out of the housing. To facilitate the exchange of running wheel blocks, alignment of the running wheel block with respect to the travelling mechanism girder is secured through the use of a machined groove, in which a machined plate is held in a form-fitting manner, arranged on the connection surface of the running wheel block. After the running wheel block has been properly aligned, the plate is fixedly connected to the travelling mechanism girder, maintaining the alignment. The invention also relates to a method for the installation of an arrangement consisting of a travelling mechanism girder and a running wheel block.

20 Claims, 4 Drawing Sheets

(56) References Cited

U.S. PATENT DOCUMENTS

| | | | | |
|---|---|---|---|---|
| 4,773,691 | A * | 9/1988 | Bernd et al. | 295/42 |
| 5,005,912 | A * | 4/1991 | Pipes | 301/111.05 |
| 5,209,167 | A * | 5/1993 | Donner et al. | 105/180 |
| 5,495,809 | A * | 3/1996 | Carbo | 105/157.1 |
| 5,931,584 | A * | 8/1999 | Becker et al. | 384/59 |
| 5,943,960 | A * | 8/1999 | Becker et al. | 105/180 |
| 6,033,119 | A | 3/2000 | Becker et al. | |
| 6,681,702 | B1 * | 1/2004 | Nicely | 105/157.1 |
| 2007/0273226 | A1 * | 11/2007 | Jansen et al. | 310/89 |
| 2014/0000472 | A1 * | 1/2014 | Schlierbach-Knobloch et al. | 104/106 |

FOREIGN PATENT DOCUMENTS

| | | | |
|---|---|---|---|
| DE | 19540220 | C1 | 4/1997 |
| DE | 102004008552 | B3 | 7/2005 |
| FR | 2004441 | | 11/1969 |
| SU | 1110741 | A1 | 8/1984 |

* cited by examiner

ARRANGEMENT CONSISTING OF A TRAVELLING GEAR CARRIER AND A RUNNING WHEEL BLOCK FASTENED DETACHABLY THERETO, AND INSTALLATION METHOD THEREFOR

CROSS REFERENCE TO RELATED APPLICATION

The present application claims the priority benefits of International Patent Application No. PCT/EP2012/056681, filed on Apr. 12, 2012, which is hereby incorporated herein by reference in its entirety.

BACKGROUND OF THE INVENTION

The invention relates to an arrangement comprising a travelling mechanism girder and a running wheel block releasably attached thereto, wherein the running wheel block is comprised of a housing having at least one connection surface and a running wheel mounted in the housing and protruding out of the housing, and the running wheel block is aligned with respect to the travelling mechanism girder.

The invention also relates to a method for assembling an arrangement comprising a travelling mechanism girder and a running wheel block, wherein the running wheel block is comprised of a housing having at least one connection surface and a running wheel mounted in the housing and protruding out of the housing, wherein the running wheel block is aligned with respect to the travelling mechanism girder and is screwed thereto.

Various types of running wheel blocks are known whose design provides for or allows for the replacement of the running wheel or running wheel block in different ways.

German patent specification DE 10 2004 008 552 B3 discloses a cuboid running wheel block having a housing which has at least one connection surface receiving a bearing force. Rotary bearing seating surfaces for sliding and/or roller bearings for supporting a running wheel are disposed in opposite sidewalls of the housing. In order to remove the running wheel from the housing, the sliding and/or roller bearings can be removed from the exterior and the running wheel can be dismounted towards a side located approximately transversely thereto.

Furthermore, German patent specification DE 31 34 750 C2 discloses running wheel blocks which are formed from two halves of a bearing housing welded together. Rotary bearing seating surfaces for bearings are press-fit into the bearing housing, and a hub of a running wheel is supported in the seating surfaces. In order to screw the running wheel block to a travelling mechanism girder, such as for an end carriage of a crane, bores are provided in an upper connection surface and all other sides of the housing and are used to accommodate attachment screws. However, it is only possible to replace this running wheel block in its entirety. After replacement, the entire running wheel block must again be attached to the travelling mechanism girder in precisely the same way as in the initial assembly, by means of screws. The running wheel block is to be aligned with the other running wheels in its position relative to the travelling mechanism girder so that the rotational axis of the running wheel extends perpendicularly with respect to the running wheel track on which the running wheel rolls.

Because of the alignment, this assembly process is time-intensive. If the alignment process is not implemented, there is the risk that the running wheels are chipped or abraded due to skewing on the running wheel track, resulting in more rapid wear. In the case of a bridge crane, there is also the risk that the travelling behavior of the bridge crane is susceptibly disrupted by skewing, rubbing and flange wear. In addition, as the skew angle increases, lateral forces occur which impart stress to the travelling mechanism girder beyond the service conditions. This problem is described in detail in DIN 15018.

SUMMARY OF THE INVENTION

The present invention provides a way of simplifying the replacement of running wheel blocks.

An arrangement, according to an aspect of the invention, includes a travelling mechanism girder and a running wheel block releasably attached thereto, wherein the running wheel block is comprised of a housing having at least one connection surface and a running wheel mounted in the housing and protruding out of the housing, and the running wheel block is aligned with respect to the travelling mechanism girder. Arranged on the connection surface of the running wheel block is a machined groove, in which a machined plate is held in a positive-locking manner. After alignment of the running wheel block with respect to the travelling mechanism girder has been effected, the plate is fixedly connected to the travelling mechanism girder in a non-releasable and immovable manner. Simplified replacement of a running wheel block is achieved by virtue of the fact that the plate remains on the travelling mechanism girder, maintaining the effected alignment of the running wheel block with respect to the travelling mechanism girder. When replacing the running wheel block due to wear or a defect, the new running wheel block, which also includes a groove in accordance with the invention, can simply be installed without re-aligning the track of the new running wheel block. The plate and the groove form a positive-locking connection in accordance with the tongue and groove principle for ensuring the alignment.

The groove and the plate may be formed such that an effected alignment of the track of the running wheel is maintained while still allowing for adjustment of the width of the track of the running wheel. Therefore, when replacing the running wheel block, the alignment is already established and any required adjustment of the track width is easily achieved by laterally displacing the running wheel block. After the track width has been adjusted, the screw connection of the running wheel block to the travelling mechanism girder is tightened.

The plate may be welded to the travelling mechanism girder.

In order to achieve simple adjustability of the track width, the groove in the connection surface may form opposing and linear guide surfaces against which the rectangular plate lies. For this purpose, it is necessary that the linear guide surfaces of the groove are aligned in parallel with the rotational axis of the running wheel of the running wheel block. The track width is adjusted when the screw connection between the running wheel block and the travelling mechanism girder is loosened.

The actual attachment of the running wheel block to the travelling mechanism girder may be effected via a screw connection.

The connection surface may be formed by two outer-lying, lateral, raised surfaces between which the groove is arranged.

The plate may have a thickness corresponding to the depth of the groove.

The travelling mechanism girder may be a component of a travelling crane, a gantry crane or a crane trolley. Of course, in the case of these cranes, the alignment of the running wheel blocks with respect to the rails is important and also costly. Only with effective alignment can increased wear of the running wheels be avoided.

A method for assembling an arrangement comprising a travelling mechanism girder and a running wheel block, wherein the running wheel block is comprised of a housing having at least one connection surface and a running wheel mounted in the housing and protruding out of the housing, according to an aspect of the invention, includes aligning the running wheel block with respect to the travelling mechanism girder and releasably attaching thereto. Simplified replacement of a running wheel block is achieved by virtue of the fact that after alignment of the running wheel block with respect to the travelling mechanism girder has been effected, a machined plate held in a positive-locking manner in a machined groove of the connection surface of the running wheel block is fixedly connected to the travelling mechanism girder. When initially assembling the running wheel block to the travelling mechanism girder, the plate may first be inserted loosely into the groove and oriented together with the running wheel block to the proper alignment before connecting the plate in a non-releasable manner to the travelling mechanism girder so as to permanently remain in this position.

The plate may be welded to the travelling mechanism girder.

BRIEF DESCRIPTION OF THE DRAWINGS

Further details, features and advantages of the invention will be apparent from the following description of an exemplified embodiment with the aid of the drawing, in which.

DETAILED DESCRIPTION OF THE PREFERRED EMBODIMENT

Figure 1:
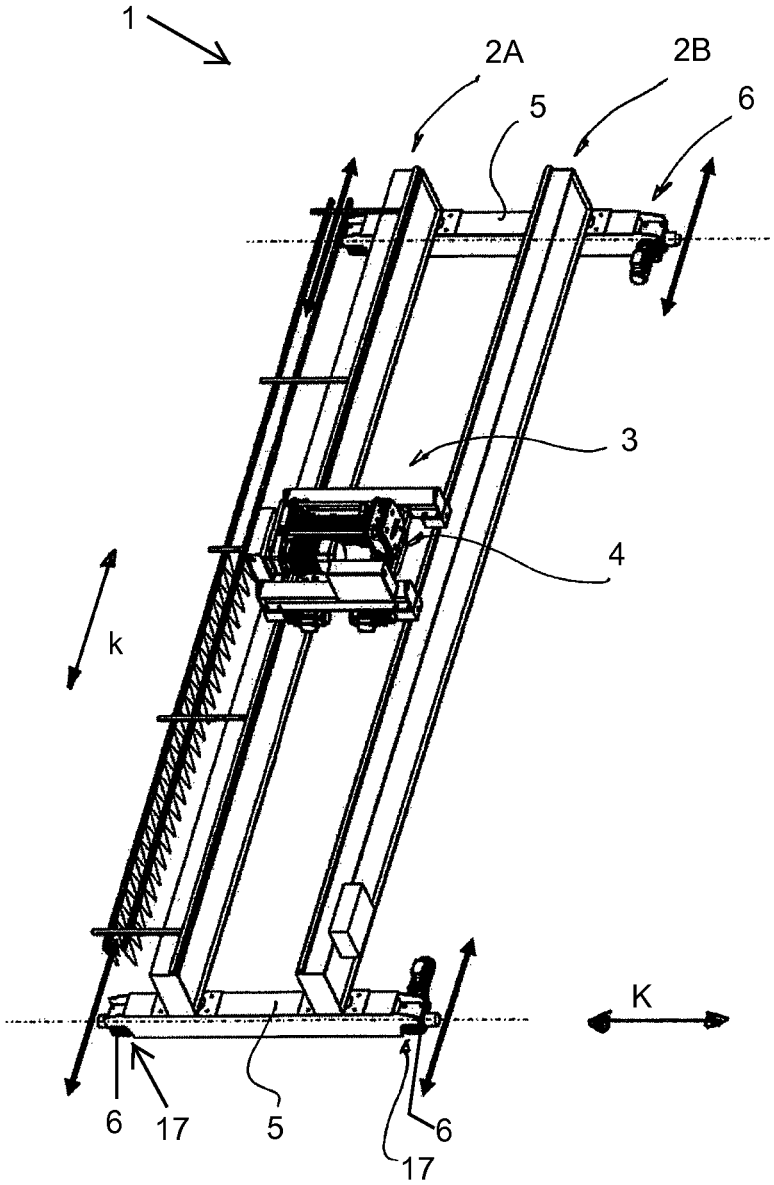
FIG. 1 shows a schematic, perspective view of a travelling crane.

FIG. 1 illustrates a travelling crane 1 designated as a whole by the reference numeral 1 and formed as a so-called double-girder bridge crane. The travelling crane 1 can travel substantially horizontally in a crane travel direction K on a rail path having two mutually parallel and spaced apart rails. The rails are illustrated only schematically by dot-dash lines.

The travelling crane 1 includes two box girders 2A and 2B which extend in parallel with, and at a spaced disposition with respect to, each other and form a horizontal crane girder and are used as a travel path for a trolley 3 having a lifting gear 4. The trolley 3 travels on the box girders 2A and 2B in a horizontal trolley travel direction k which is aligned perpendicularly with respect to the crane travel direction K. In a corresponding manner, the box girders 2A and 2B likewise extend in the trolley travel direction k. Alternatively, only a single box girder or I-profile can be provided in the manner of a single-girder bridge crane. The trolley 3 then travels on a lower flange of the box girder.

The box girders 2A and 2B lie with their respective opposite ends on travelling mechanism girders 5 which extend transversely with respect thereto and thus in the crane travel direction K. A running wheel block 6 is disposed on each of the opposite ends of the box girders 2A and 2B and is optionally driven by an electric motor. The running wheel blocks 6 can travel in the crane travel direction K on the rails, not illustrated.

Figure 2:
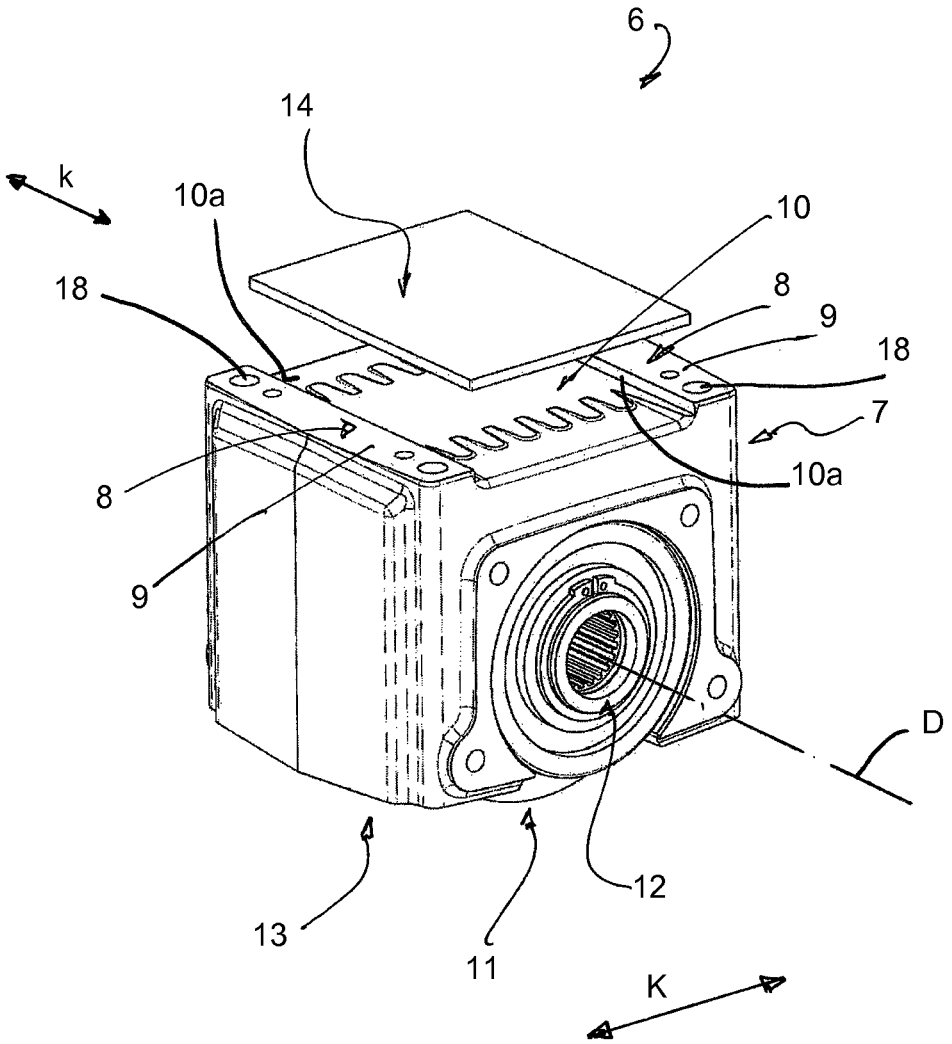
FIG. 2 shows a schematic, perspective view of a running wheel block of the travelling crane from FIG. 1.

FIG. 2 shows a schematic, perspective view of the running wheel block 6 which comprises in each case a box-shaped housing 7 open at the bottom, on whose upper side there is provided an upper connection surface 8 which is also called a top connection surface. The connection surface 8 is delimited by two raised and planar surfaces 9 which are each outer-lying and thus lie at the front and rear in the crane travel direction K. The surfaces 9 extend over the entire width of the housing 7. Disposed between the surfaces 9 as seen in the crane travel direction K is a planar and deep-lying machined region or a machined groove 10 which separates the surfaces 9 in the connection surface 8 from each other. The groove 10 extends over the entire width of the housing 7 and between its open sides. This extension direction extends in the trolley travel direction k. As seen in the crane travel direction K, the groove 10 is also delimited at the front and rear by guide surfaces 10*a* which are formed by the surfaces 9.

Mounted in the housing 7 is a running wheel 11 which rotates with a hub 12 about a horizontal rotational axis D extending transversely with respect to the crane travel direction K and partly protrudes out of the housing 7 downwards towards a lower side 13 which lies opposite the connection surface 8. In the conventional mounting position, the rotational axis D is oriented horizontally. The hub 12 is held laterally in each case in sliding and/or roller bearings which are inserted into the housing 7.

A plate 14 can be inserted into the machined-to-size groove 10, which plate is likewise machined-to-size. The plate 14 then lies against the two guide surfaces 10*a* of the groove 10. The plate 14 and the groove 10 are machined such that they form a mutual positive-locking and accurately fitting connection with each other.

It can also be seen in FIG. 2 that attachment bores 18 are arranged in the surfaces 9. Two attachment bores 18 are provided for each surface 9 in the region of the lateral ends of the surfaces 9. These attachment bores 18 (four in total) are used to releasably attach the running wheel block 6 to the travelling mechanism girder 5. For this purpose, the attachment bores 18 are formed as through-going bores or threaded bores. Instead of the attachment bores 18, a groove having an undercut can also be provided in each surface 9, wherein sliding blocks functioning as nuts can then be inserted into the grooves.

Figure 4:
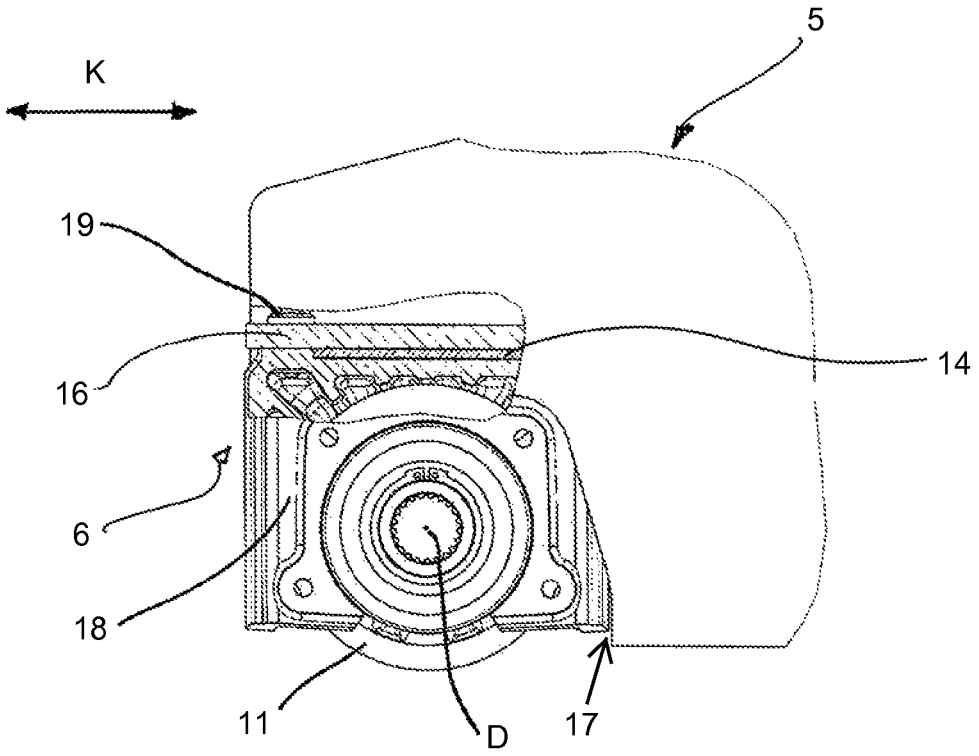
FIG. 4 shows a partly sectional, schematic, side view of an end of a travelling mechanism girder in accordance with FIG. 3.

FIG. 4 shows a partially sectional, schematic, side view of an end of a travelling mechanism girder 5 having an attached running wheel block 6. The end of the travelling mechanism girder 5 comprises a recess 17 which is open at the bottom, the sides and at the front or rear as seen in the crane travel direction K. The recess 17 is delimited at the top by a planar and rectangular attachment plate 16 which is a component of the travelling mechanism girder 5. During initial assembly of a running wheel block 6 at one end of the travelling mechanism girder 5, the running wheel block 6 is inserted into the recess 17 and its connection surface 8 comes to lie against the side of the attachment plate 16 facing the recess. Then, the running wheel block 6 is screwed to the travelling mechanism girder 5 using four screws 19 which extend through the attachment bores 18. The plate 14 is loosely inserted into the groove 10 and assembled therewith. Then, the running wheel block 6 is oriented in the crane travel direction K, i.e., the track of the running wheel block 6, in order to be able to roll along the rails of the travelling crane 1 with low wear. In this respect, the running wheel block 6 is pivoted about a notional vertical axis and is thus oriented in relation to its track. After the running wheel block 6 has been aligned and after the running wheel block 6 has been fixedly screwed, the plate 14 is then welded to the attachment plate 16 of the travelling mechanism girder 5 and is thus fixed in a non-releasable and immovable manner. For preferred plug welding, the attachment plate comprises four bores 15 which lie in the region of a fitted plate 14. By providing welding in the bores, the underlying plate 14 is fixedly connected to the travelling mechanism girder 5. After assembly has been effected, the plate 14 is thus a component of the travelling mechanism girder 5. Alternatively, pins and screws can also be used in addition to the plug welding.

Should it now become necessary to replace a running wheel block 6 owing to wear or a defect thereof, the screws 19 are loosened and the plate 14 remains in the welded position. Then, a new running wheel block 6 of the same type having the groove 10, machined-to-size, is inserted and screwed. Since the plate 14 is already aligned in relation to the crane travel direction K and thus the track of the running wheel block 6, the alignment can be omitted when a change is being made and the assembly is simplified. The track width can simply be adjusted since the running wheel block 6 can be displaced transversely with respect to the crane travel direction K with its guide surfaces 10*a* along the plate 14 so long as the running wheel block 6 is not yet fixedly screwed to the travelling mechanism girder 5. The new running wheel block 6 is inevitably correctly oriented in relation to its track via the plate 14.

Figure 3:
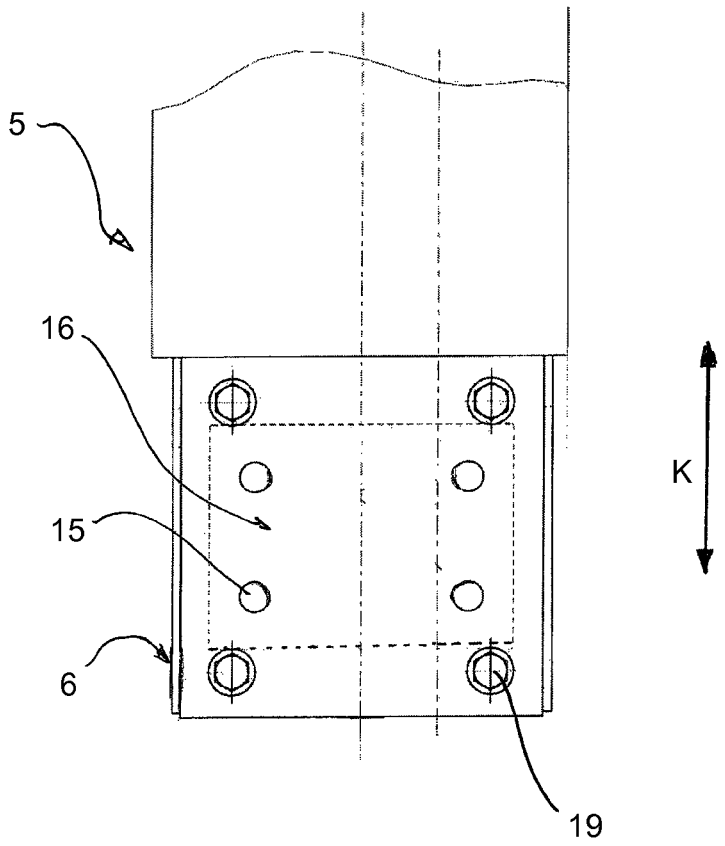
FIG. 3 shows a schematic, plan view of an end of a travelling mechanism girder of the travelling crane from FIG. 1.

FIG. 3 shows a schematic, plan view of an end of a travelling mechanism girder 5 of the travelling crane 1 from FIG. 1. The arrangement of the bores 15 for the attachment of the plate 14 via the plug welding on the attachment plate 16 can be seen particularly clearly in this view. The screws 19 for releasably attaching the running wheel block 6 to the travelling mechanism girder 5 can also be seen.

The invention claimed is:

1. An arrangement comprising:

a travelling mechanism girder;

a running wheel block releasably attached to the traveling mechanism girder and aligned with respect to the travelling mechanism girder, wherein the running wheel block comprises a housing having at least one connection surface and a running wheel, the connection surface comprising a groove;

wherein the running wheel is mounted in the housing and protrudes out of the housing; and a plate that is positively-locked in the groove to maintain alignment of the running wheel block with respect to the travelling mechanism girder, such that the plate is fixedly connected to the travelling mechanism girder.

2. The arrangement as claimed in claim 1, wherein the groove and the plate are configured to maintain the alignment of the running wheel block with respect to the travelling mechanism girder while also allowing for adjustment of the running wheel block parallel to a rotational axis of the running wheel.

3. The arrangement as claimed in claim 2, wherein the travelling mechanism girder is a component of a travelling crane, a gantry crane or a crane trolley.

4. The arrangement as claimed in claim 2, wherein the plate has a thickness corresponding to a depth of the groove.

5. The arrangement as claimed in claim 2, wherein the groove is arranged between the connection surface that is formed by two outer-lying, lateral, and raised surfaces.

6. The arrangement as claimed in claim 2, wherein the plate is welded to the travelling mechanism girder.

7. The arrangement as claimed in claim 2, wherein the groove in the connection surface forms opposing and linear guide surfaces against which the rectangular plate abuts.

8. The arrangement as claimed in claim 7, wherein the linear guide surfaces of the groove are aligned substantially parallel with the rotational axis of the running wheel of the running wheel block.

9. The arrangement as claimed in claim 2, wherein the running wheel block is screwed to the travelling mechanism girder.

10. The arrangement as claimed in claim 1, wherein the plate is welded to the travelling mechanism girder.

11. The arrangement as claimed in claim 1, wherein the groove of the connection surface forms opposing and linear guide surfaces against which the plate abuts.

12. The arrangement as claimed in claim 11, wherein the linear guide surfaces of the groove are aligned substantially parallel with the rotational axis of the running wheel of the running wheel block.

13. The arrangement as claimed in claim 12, wherein the groove is arranged between the connection surface that is formed by two outer-lying, lateral, raised surfaces.

14. The arrangement as claimed in claim 11, wherein the groove is arranged between the connection surface that is formed by two outer-lying, lateral, raised surfaces.

15. The arrangement as claimed in claim 1, wherein the running wheel block is screwed to the travelling mechanism girder.

16. The arrangement as claimed in claim 1, wherein the groove is arranged between the connection surface that is formed by two outer-lying, lateral, and raised surfaces.

17. The arrangement as claimed in claim 1, wherein the plate has a thickness corresponding to a depth of the groove.

18. The arrangement as claimed in claim 1, wherein the travelling mechanism girder is a component of a travelling crane, a gantry crane or a crane trolley.

19. A method for assembling an arrangement having a travelling mechanism girder and a running wheel block, the method comprising:

aligning the running wheel block with respect to the travelling mechanism girder, wherein the running wheel block comprises a housing having at least one connection surface that has a groove for positively locking a plate inserted therein;

attaching the running wheel block to the travelling mechanism girder in a releasable manner; and connecting the plate to the travelling mechanism girder in a non-releasable and immovable manner.

20. The method as claimed in claim 19, wherein the plate is welded to the travelling mechanism girder.

* * * * *